US007607946B2

(12) United States Patent
Lin et al.

(10) Patent No.: US 7,607,946 B2
(45) Date of Patent: Oct. 27, 2009

(54) MICRO USB RECEPTACLE

(75) Inventors: Chih-Ming Lin, Taichung (TW); Chin-Tsai Shih, Taichung Hsien (TW)

(73) Assignee: Excel Cell Electronic Co., Ltd., Taichung (TW)

( * ) Notice: Subject to any disclaimer, the term of this patent is extended or adjusted under 35 U.S.C. 154(b) by 0 days.

(21) Appl. No.: 12/147,773

(22) Filed: Jun. 27, 2008

(65) Prior Publication Data

US 2009/0088013 A1 Apr. 2, 2009

(30) Foreign Application Priority Data

Sep. 28, 2007 (TW) ..... 96136203 A

(51) Int. Cl.
*H01R 13/648* (2006.01)

(52) U.S. Cl. ..... 439/607.35

(58) Field of Classification Search ..... 439/607, 439/607.35–607.4, 607.54, 607.01
See application file for complete search history.

(56) References Cited

U.S. PATENT DOCUMENTS

2005/0048840 A1* 3/2005 Zhang ..... 439/607
2007/0218762 A1* 9/2007 Liao et al. ..... 439/607
2008/0207053 A1* 8/2008 Lin et al. ..... 439/607

* cited by examiner

*Primary Examiner*—Gary F. Paumen
(74) *Attorney, Agent, or Firm*—Darby & Darby, P.C.

(57) ABSTRACT

A micro USB receptacle includes a housing surrounding an axis, a terminal seat extending into the housing along the axis, and an engaging unit. The engaging unit has a first engaging member provided on the terminal seat, and a resilient second engaging member provided on the housing and having an engaging hole for retaining the first engaging member therein and an inner surrounding surface that defines the engaging hole. The first engaging member is formed with a stop surface for abutting against the inner surrounding surface of the second engaging member to arrest separation of the terminal seat from the housing.

13 Claims, 11 Drawing Sheets

MICRO USB RECEPTACLE

CROSS-REFERENCE TO RELATED APPLICATION

This application claims priority of Taiwanese Application No. 096136203, filed on Sep. 28, 2007.

BACKGROUND OF THE INVENTION

1. Field of the Invention

The invention relates to a Universal Serial Bus (USB) receptacle, more particularly to a micro USB receptacle.

2. Description of the Related Art

Portable electronic products have a trend toward small size and light weight. Thus, the components of the portable electronic products are designed to be smaller and lighter to meet the requirement. As shown in FIGS. 1 and 2, a conventional USB receptacle 1 is adapted for use in a portable electronic product, such as a mobile phone, a personal digital assistant (PDA), a digital camera, or the like. The conventional USB receptacle 1 includes a housing 3 having a surrounding wall 31 that surrounds an axis (L) and that defines a receiving space 30 therein, and a terminal seat 2 extending into the housing 3 along the axis (L). The terminal seat 2 has a stop section 21, and a connecting section 22 that extends from the stop section 21 along the axis (L) and that has an axial length (D), and that is formed with a pair of spaced apart stop blocks 23. Each of the stop blocks 23 is formed with a stop surface 231 having a height (h). The housing 3 further has a pair of resilient plates 32, each of which extends obliquely relative to the axis (L) from the surrounding wall 31 into the receiving space 30, and has an end surface 321 (see FIG. 5).

As further shown in FIGS. 3 to 5, when assembling the conventional USB receptacle 1, the terminal seat 2 is extended into the housing 3 and is snap-fitted in the receiving space 30 in the housing 3 via the resilient deformation of the resilient plates 32 of the housing 3, such that the stop blocks 23 of the terminal seat 2 engage respectively the resilient plates 32 of the housing 3, and that the stop surface 231 of each of the stop blocks 23 confronts the end surface 321 of one of the resilient plates 32. When a force is applied to the housing 3 in the same direction as that in which the terminal seat 2 is extended into the housing 3, the end surface 321 of each of the resilient plates 32 abuts against the stop surface 231 of the corresponding one of the stop blocks 23, thereby preventing separation between the terminal seat 2 and the housing 3.

However, since the contact area between the end surface 321 of each of the resilient plates 32 of the housing 3 and the stop surface 231 of the corresponding one of the stop blocks 23 of the terminal seat 2 is relatively small, an application of a larger force to the housing 3 may ultimately result in separation between the housing 3 and the terminal seat 2. Moreover, the axial distance of the surrounding wall 31 of the housing 3 from one edge 311 thereof adjacent to the stop section 21 of the terminal seat 2 to where each of the resilient plates 32 extends has a minimum limitation of (D1) (see FIG. 4) so as to preserve the connecting strength between each of the resilient plates 32 and the surrounding wall 31, thereby obstructing the miniaturization of the conventional USB receptacle 1.

Although the previous first drawback can be overcome by enlarging each of the stop blocks 23 to result in a larger contact area between the end surface 321 of each of the resilient plates 32 and the stop surface 231 of the corresponding one of the stop blocks 23, the enlarged stop blocks 23 also increase the resistance with the resilient plates 32 and may even result in damage to the resilient plates 32 during the snap-fitting process between the terminal seat 2 and the housing 3. Besides, the housing 3 has to be made larger for accumulating the terminal seat 2 with the enlarged stop blocks 23, thereby also obstructing the miniaturization of the conventional USB receptacle 1.

SUMMARY OF THE INVENTION

Therefore, the object of the present invention is to provide a USB receptacle that is easy to assemble and that has a relatively small size.

Accordingly, a micro USB receptacle of the present invention comprises a housing surrounding an axis, a terminal seat extending into the housing along the axis, and an engaging unit. The engaging unit has a first engaging member provided on the terminal seat, and a resilient second engaging member provided on the housing and having an engaging hole for retaining the first engaging member therein and an inner surrounding surface that defines the engaging hole. The first engaging member is formed with a stop surface for abutting against the inner surrounding surface of the second engaging member to arrest separation of the terminal seat from the housing.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
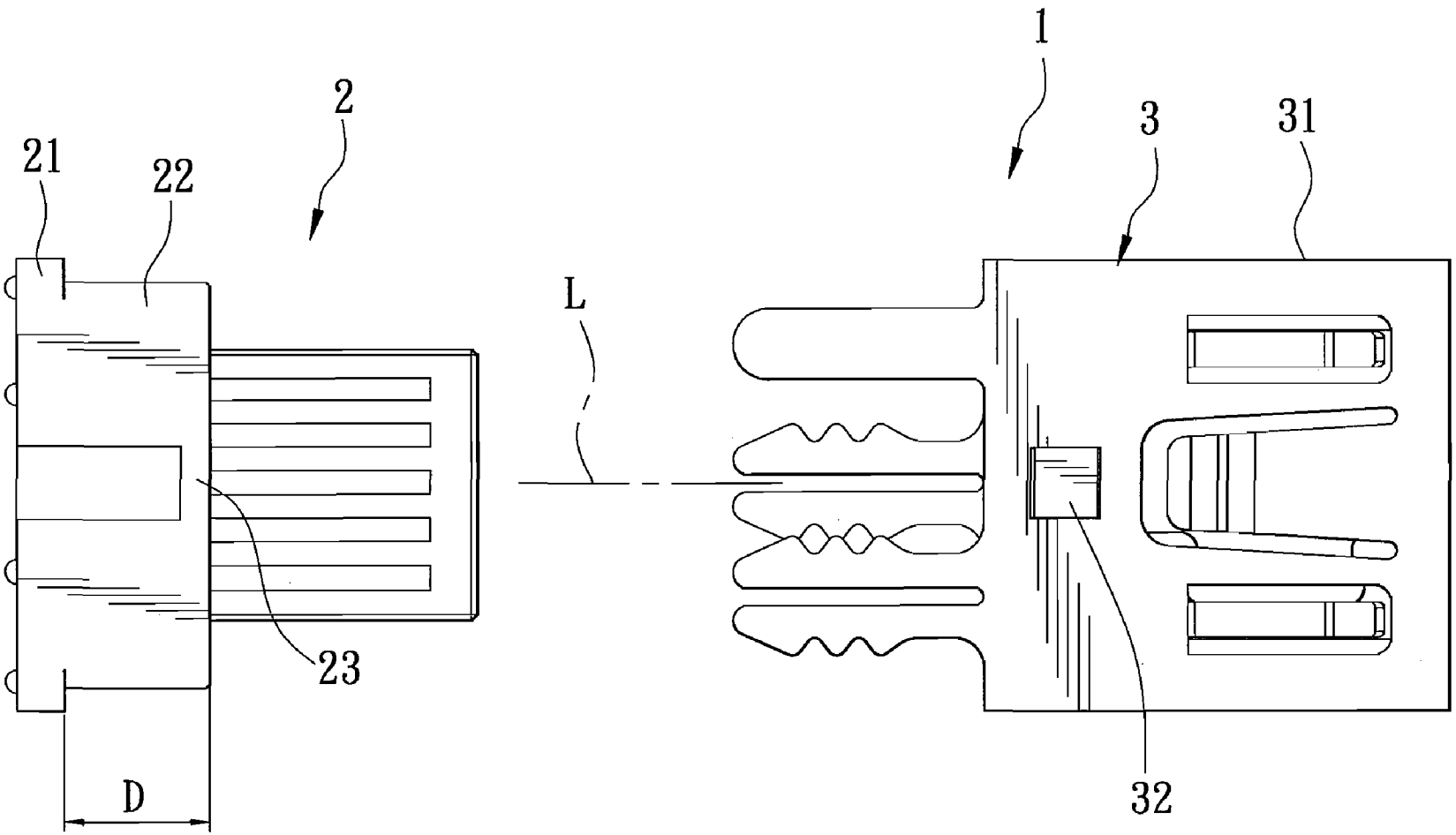
FIG. 1 PRIOR ART
FIG. 1 is an exploded schematic top view of a conventional USB receptacle.
Figure 2:
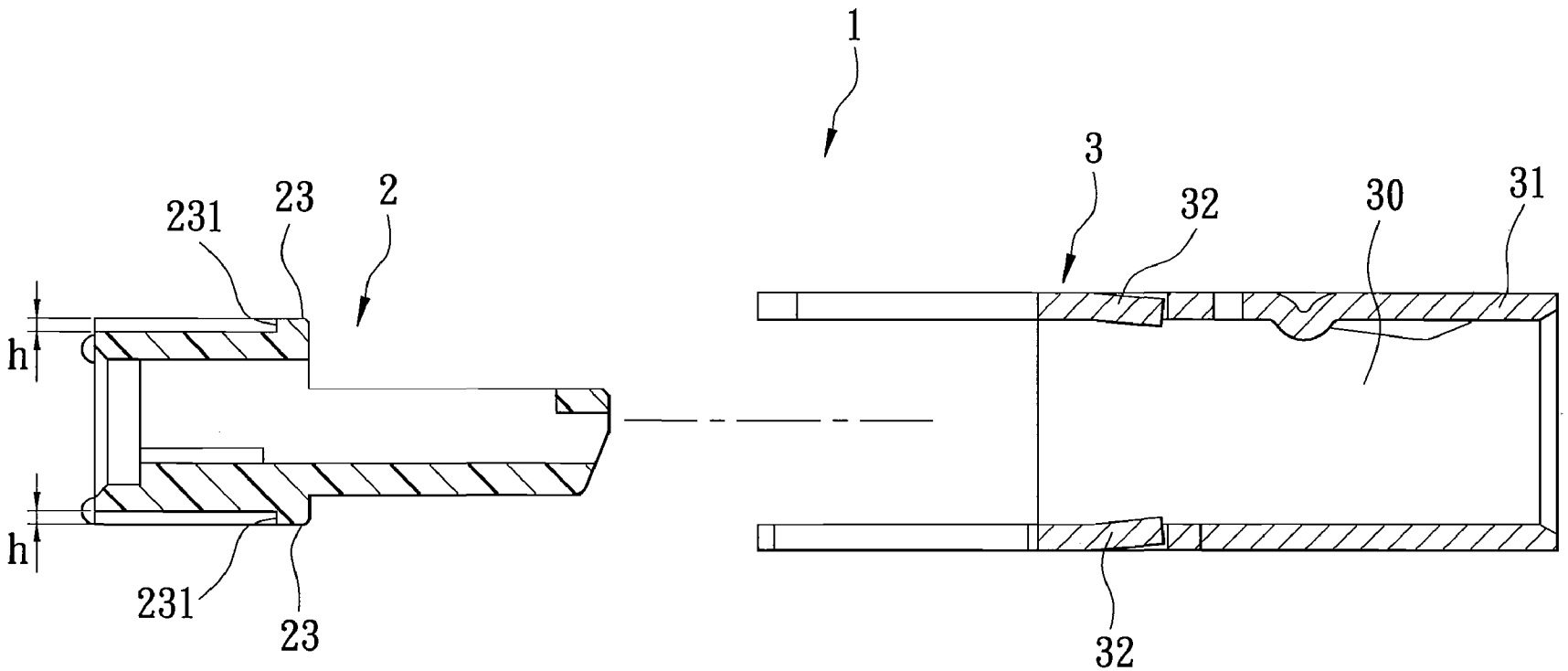
FIG. 2 PRIOR ART
FIG. 2 is an exploded sectional view of the conventional USB receptacle.
Figure 3:
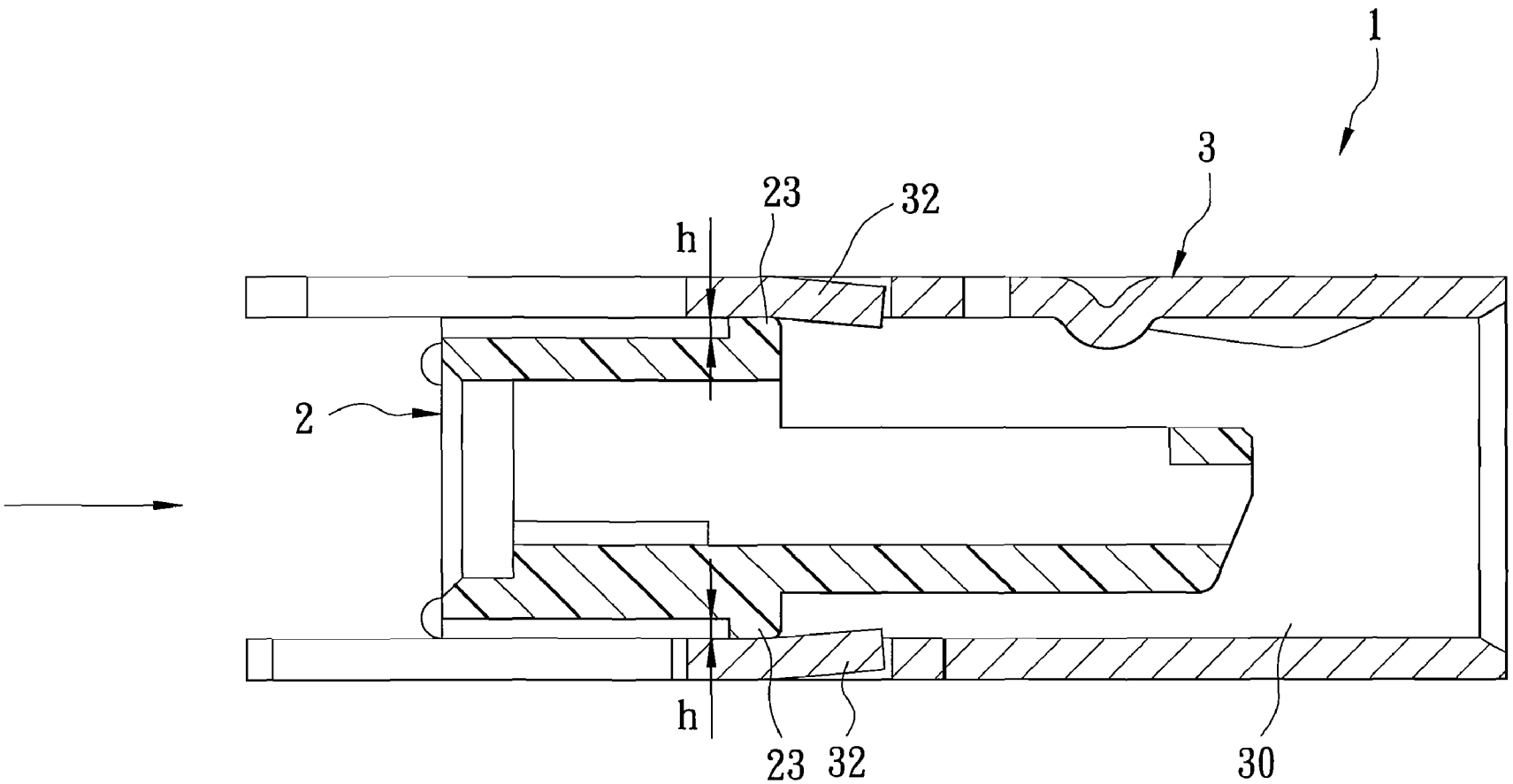
FIG. 3 PRIOR ART
FIG. 3 is a sectional view of the conventional USB receptacle during the process of extending of a terminal seat into a housing.
Figure 4:
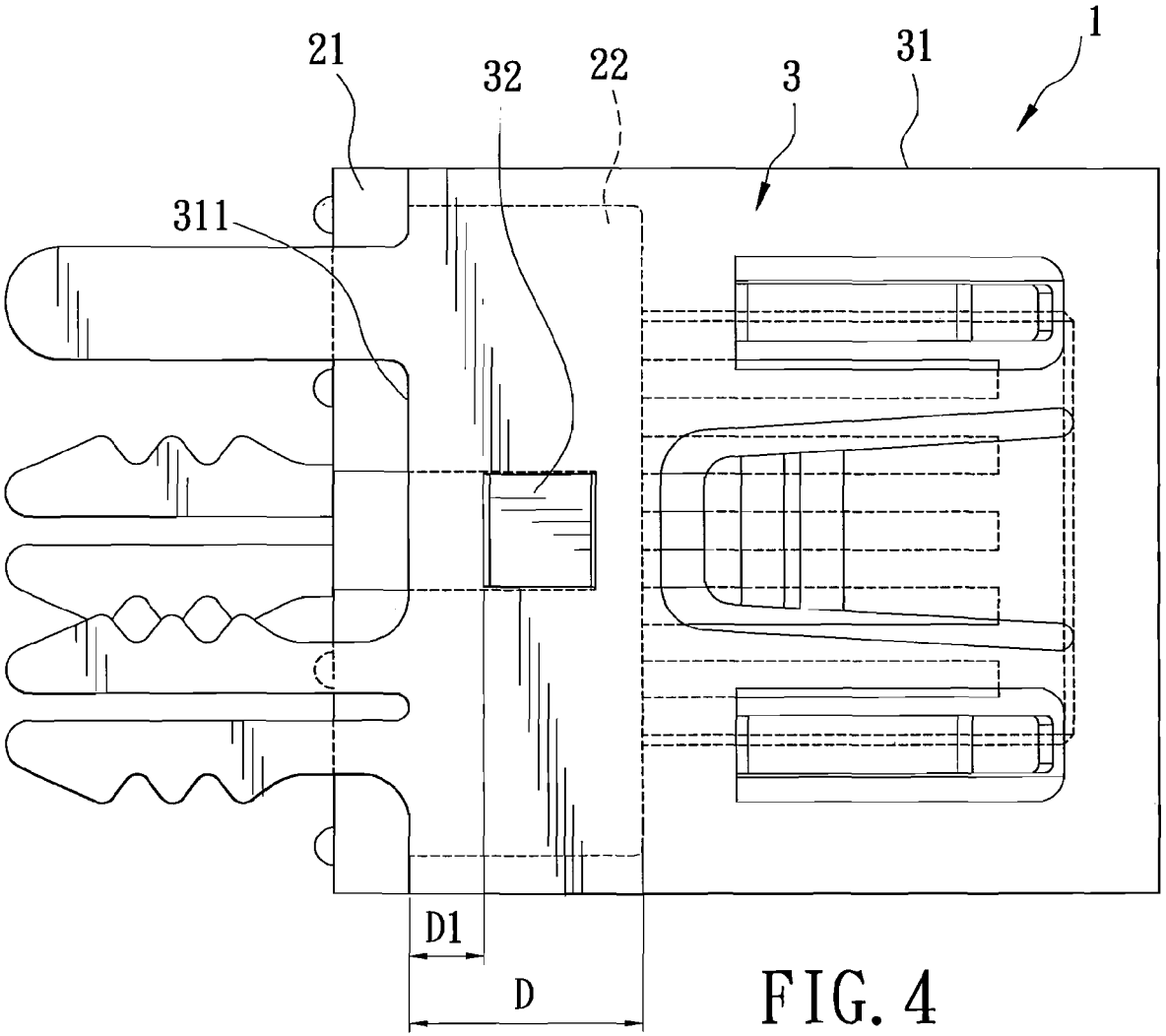
FIG. 4 PRIOR ART
FIG. 4 is an assembled schematic top view of the conventional USB receptacle.
Figure 5:
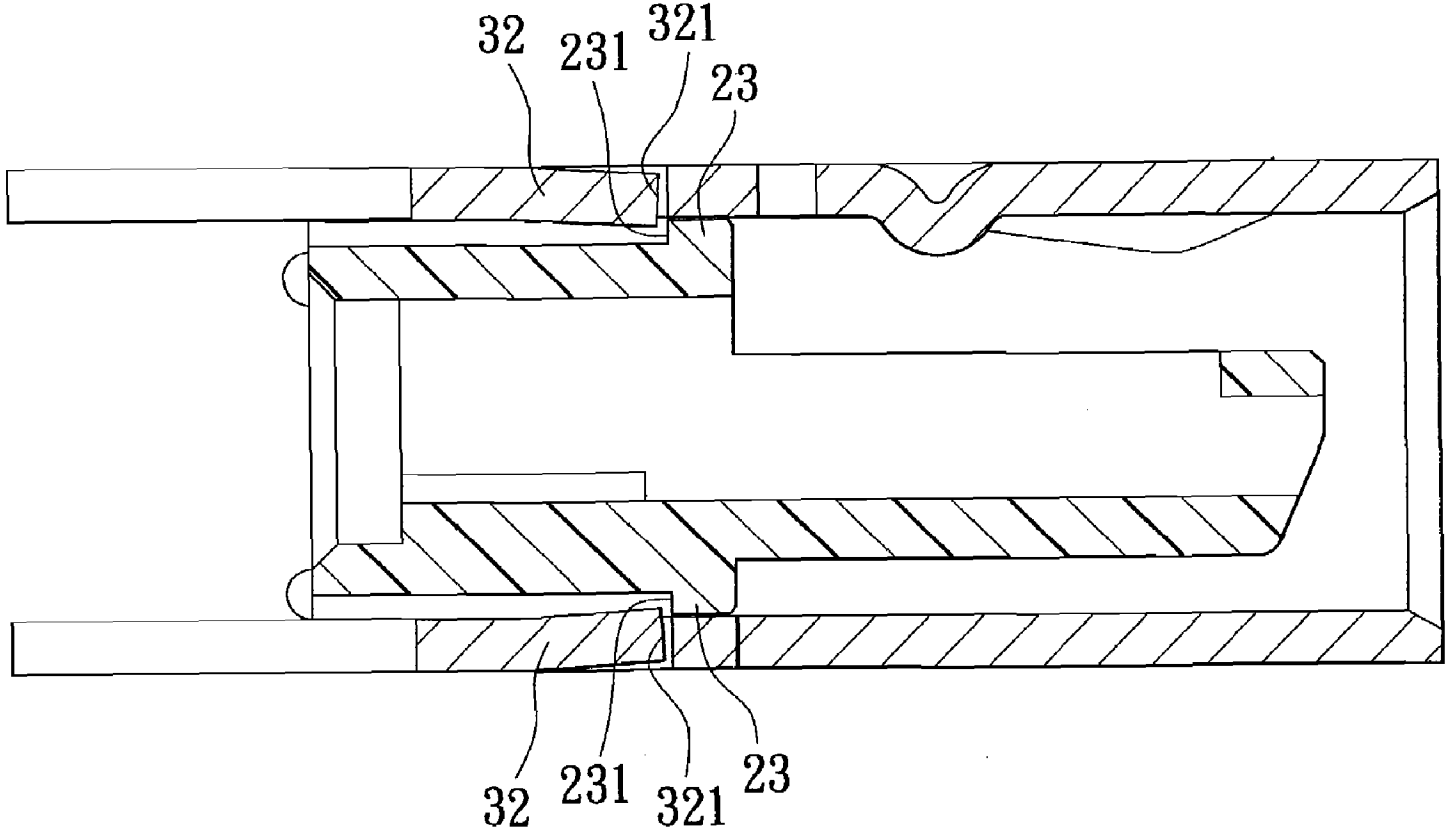
FIG. 5 PRIOR ART
FIG. 5 is an assembled sectional view of the conventional USB receptacle.
Figure 6:
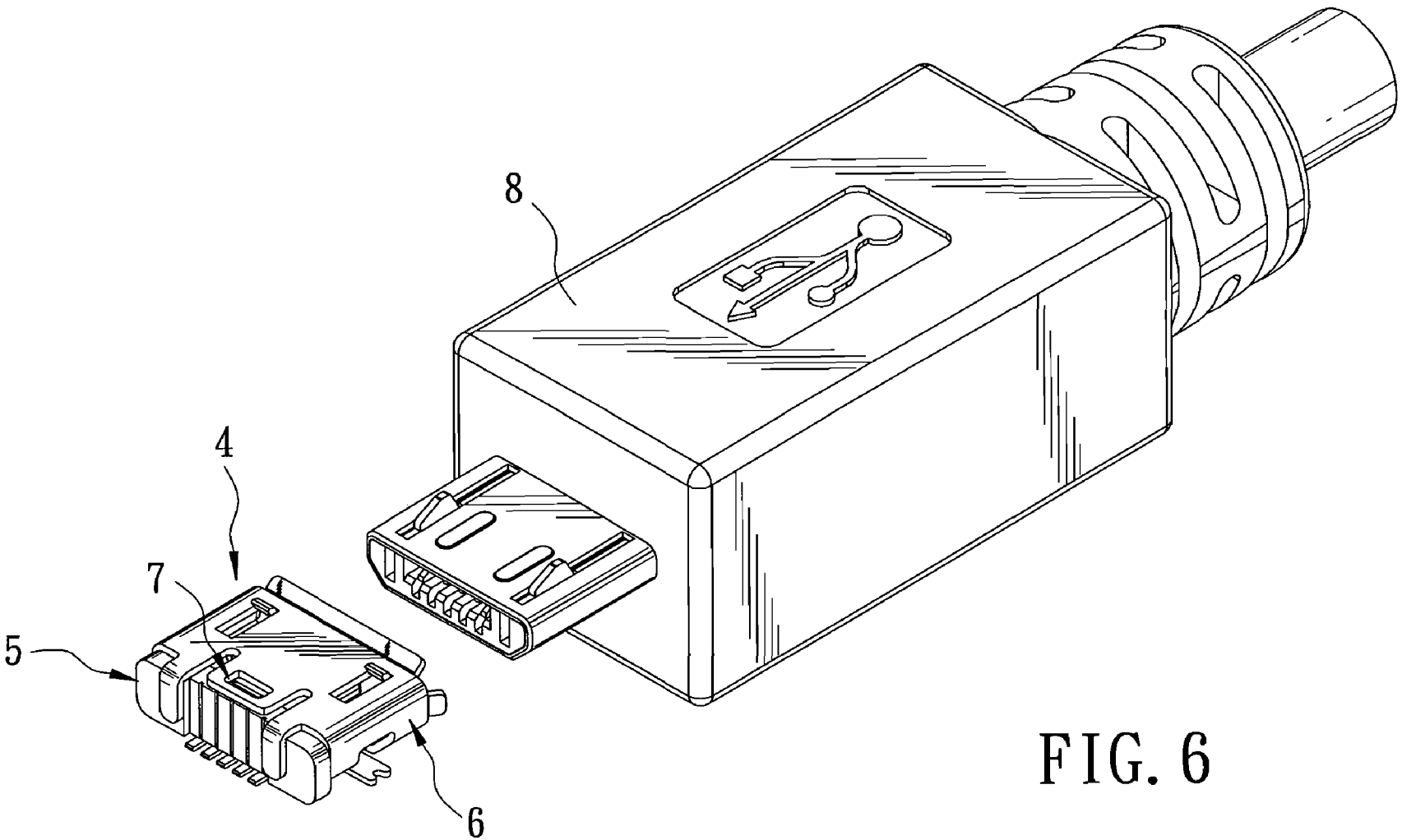
FIG. 6 is a perspective view of a micro USB connector unit including a preferred embodiment of a micro USB receptacle according to the invention.
Figure 7:
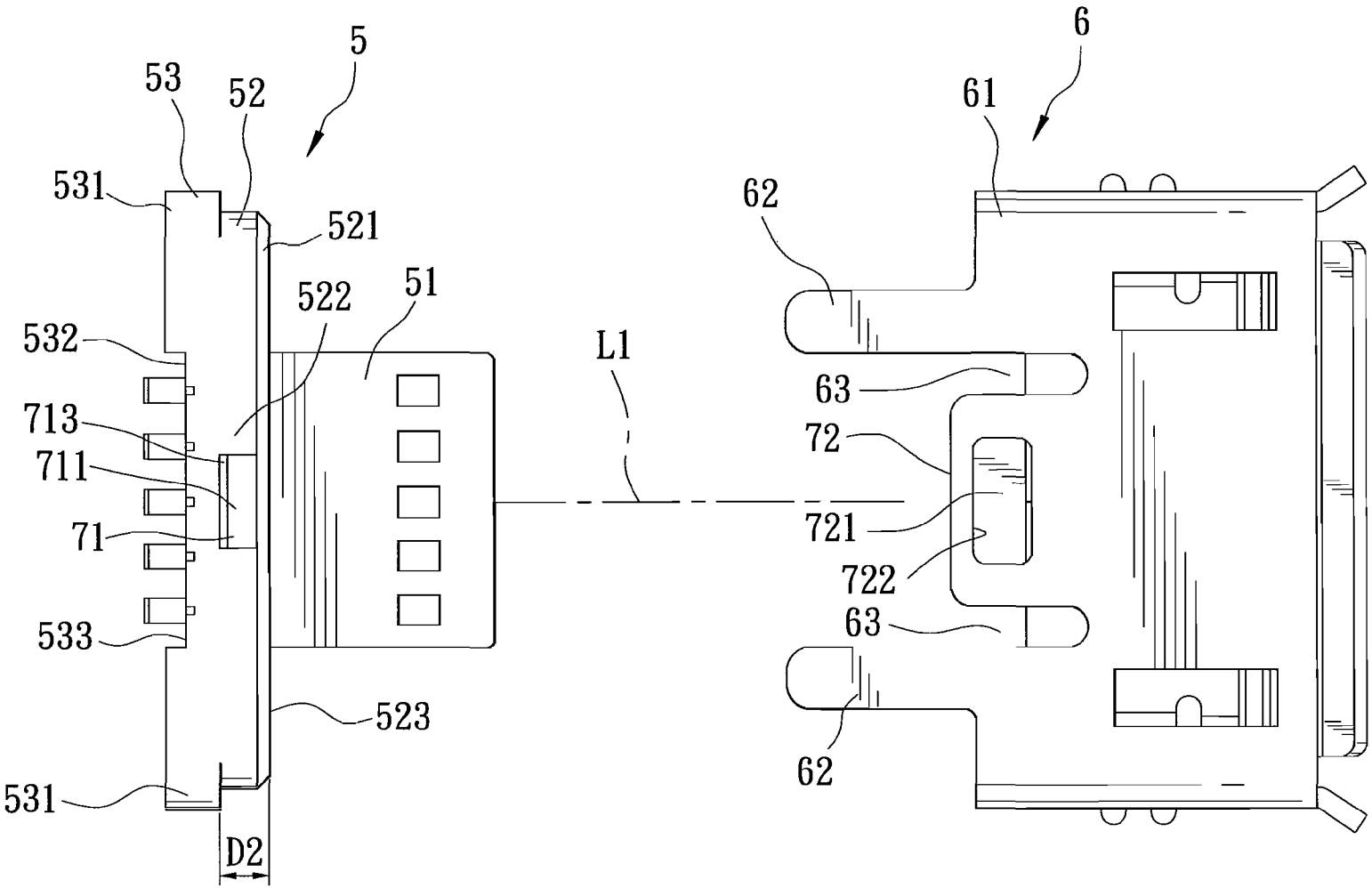
FIG. 7 is an exploded schematic top view of the preferred embodiment.
Figure 8:
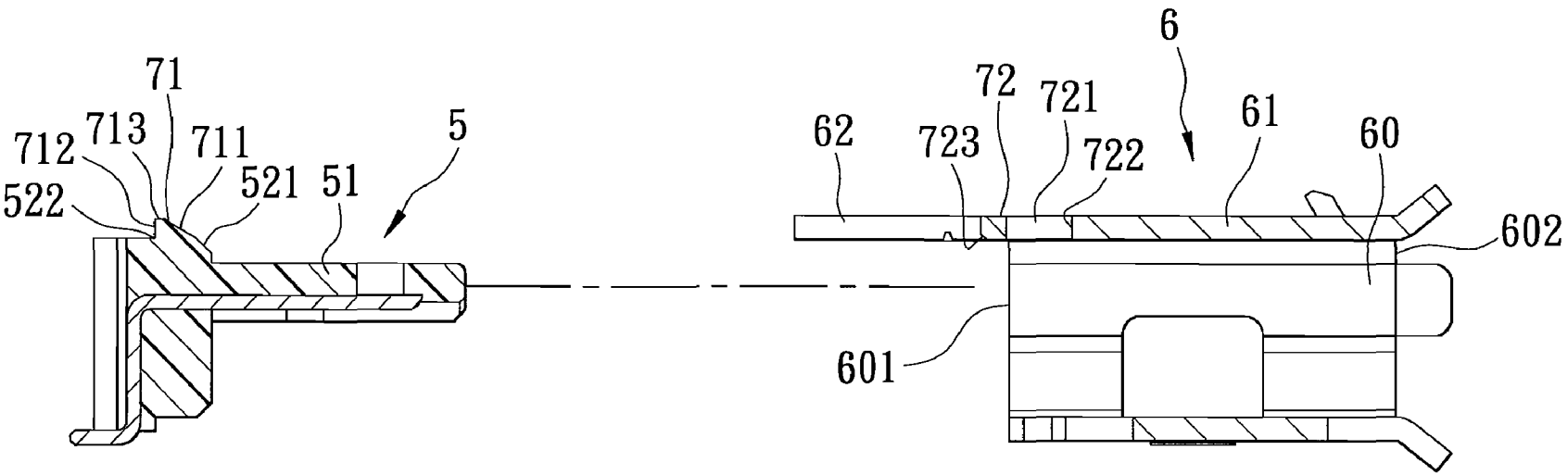
FIG. 8 is an exploded sectional view of the preferred embodiment.

As shown in FIGS. 6 to 8, the preferred embodiment of a micro USB receptacle 4 according to the present invention is adapted to form a part of a micro USB connector unit, and is adapted to be connected electrically to a micro USB plug 8 of the micro USB connector unit. The micro USB receptacle 4 comprises a housing 6 surrounding an axis (L1), a terminal seat 5 extending into the housing 6 along the axis (L1), and an engaging unit 7.

The housing 6 has a surrounding wall 61 defining a receiving space 60 that receives the terminal seat 5 therein, and that has opposite first and second openings 601, 602. The terminal seat 5 is extended into the housing 6 via the first opening 601.

The terminal seat 5 has a connecting section 52 disposed in the receiving space 60 defined by the surrounding wall 61 of the housing 6, an extending section 51 extending from the connecting section 52 toward the second opening 602 of the receiving space 60 along the axis (L1), and a stop section 53 formed at one end of the connecting section 52 opposite to the extending section 51 and extending outwardly of the surrounding wall 61 of the housing 6 along the axis (L1) In this embodiment, the connecting section 52 has an inclined surface 521, a first side surface 523 which is connected to one end of the inclined surface 521 and from which the extending section 51 extends, and a first connecting surface 522 which is connected to another end of the inclined surface 521 opposite to the first side surface 523. The stop section 53 has a pair of end portions 531 that are formed at opposite sides of the axis (L1) and that abut against the surrounding wall 61, and a recess portion 532 that is formed between the end portions 531 thereof and that has a second side surface 533. In this embodiment, the axial length (D2) of the connecting section 52 (see FIG. 7), i.e., the distance between the first side surface 523 and each of the end portions 531 of the stop section 53, is 0.6 millimeters.

The engaging unit 7 has a first engaging member 71 that is provided on the first connecting surface 522 of the connecting section 52 of the terminal seat 5, and a resilient second engaging member 72 that is provided on the housing 6 and that engages the first engaging member 71. The second engaging member 72 has an engaging hole 721 for retaining the first engaging member 71 therein, and an inner surrounding surface 722 defining the engaging hole 721. The first engaging member 71 is formed with an inclined guide surface 711 inclined relative to the axis (L1), a stop surface 712 confronting the inner surrounding surface 722 of the second engaging member 71 and having a height (H) (see FIG. 9), and a second connecting surface 713 interconnecting the inclined guide surface 711 and the stop surface 712. The inclined surface 521 of the connecting section 52 is spaced apart from the second connecting surface 713 and is connected to the inclined guide surface 711. The second engaging member 72 further has a guide corner 723, and an end surface 724 (see FIG. 11) spaced apart from the inner surrounding surface 722 and connected to the guide corner 723.

As shown in FIG. 7, the housing 6 further has a pair of slits 63 that are formed in the surrounding wall 61, that flank the second engaging member 72 of the engaging unit 7, and that extend parallel to the axis (L1), and a pair of bendable members 62 that flank the second engaging member 72 and that extend parallel to the axis (L1). Each of the slits 63 is formed between the second engaging member 72 and one of the bendable members 62.

Figure 9:
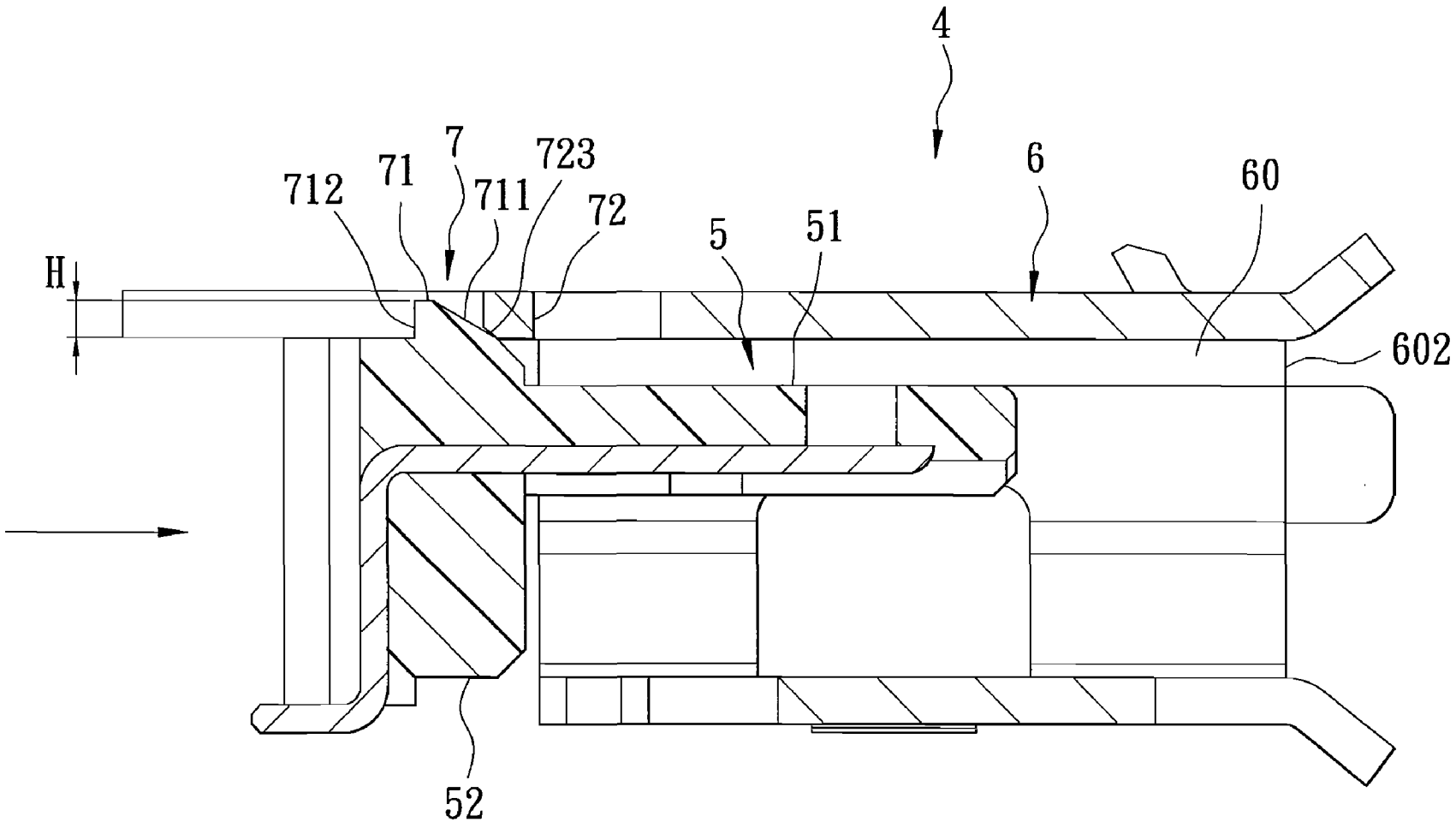
FIG. 9 is a sectional view of the preferred embodiment during the process of extending of a terminal seat into a housing.
Figure 10:
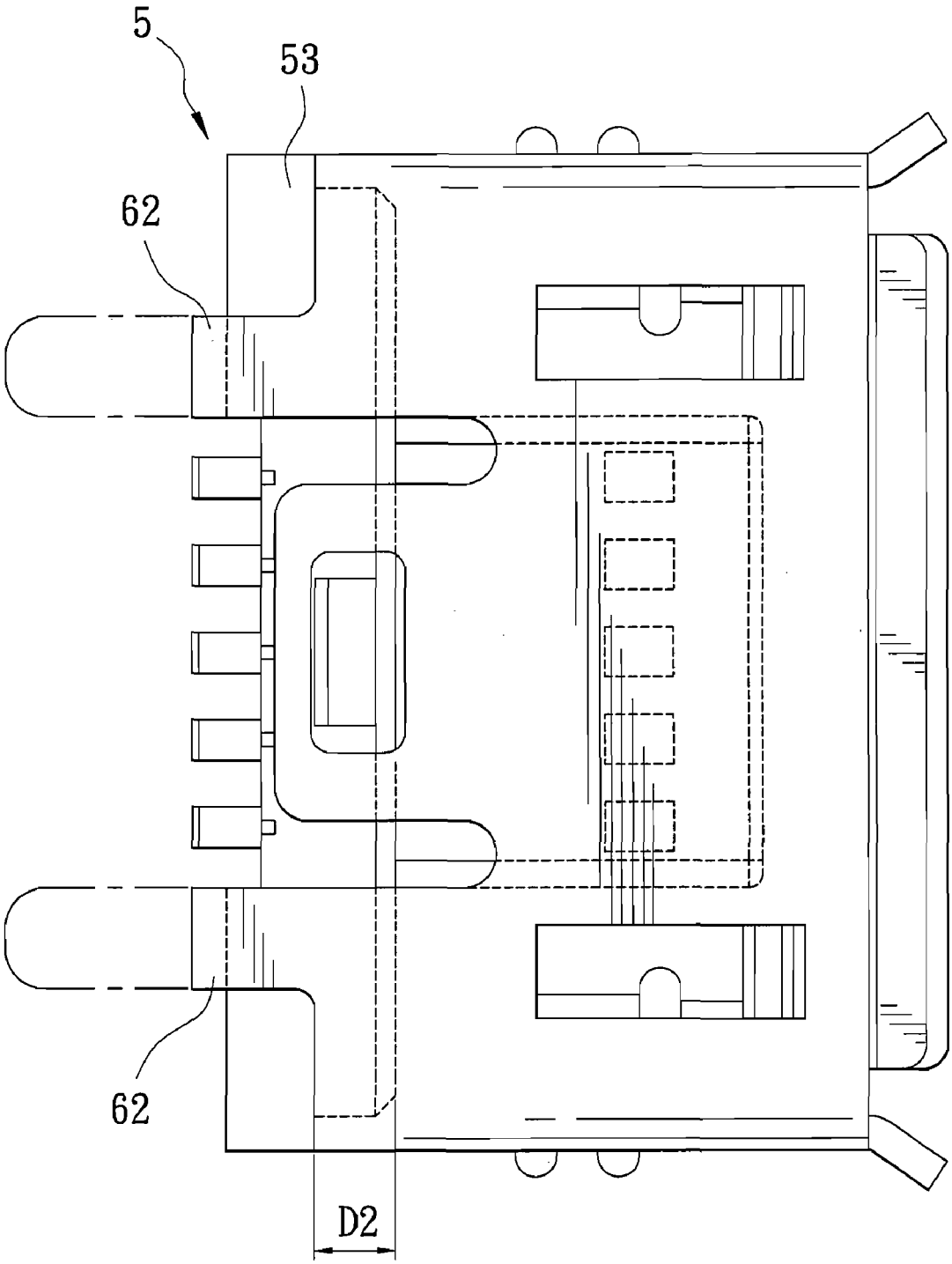
FIG. 10 is an assembled schematic top view of the preferred embodiment.
Figure 11:
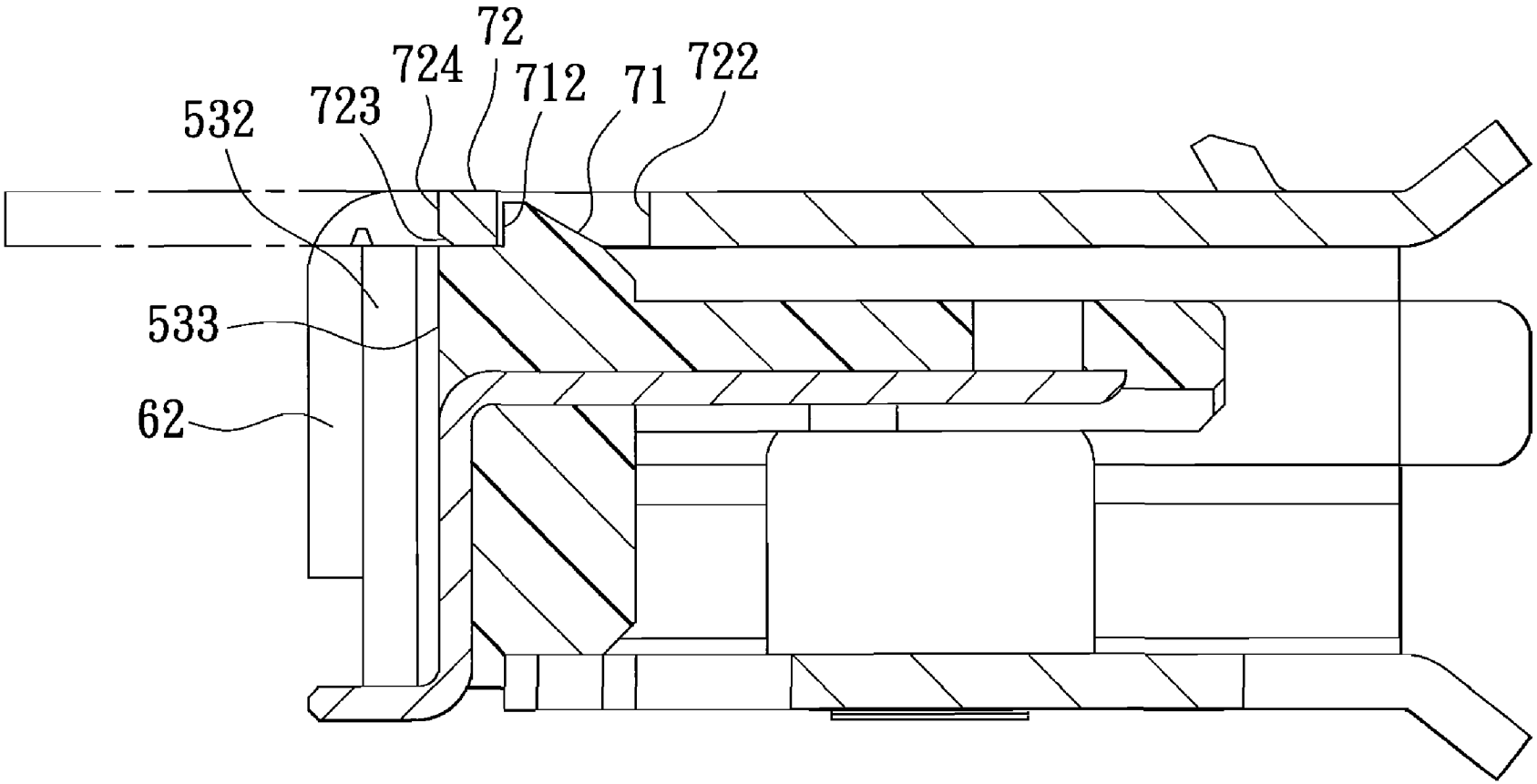
FIG. 11 is an assembled sectional view of the preferred embodiment.

As shown in FIGS. 9 to 11, when assembling the micro USB receptacle 4 of the invention, the terminal seat 5 is extended into the receiving space 60 in the housing 6, such that the inclined guide surface 711 of the first engaging member 71 of the engaging unit 7 abuts against the second engaging member 72 of the engaging unit 7, i.e., the guide corner 723 of the second engaging member 72 slides on the inclined guide surface 711, to cause resilient deformation of the second engaging member 72 to enable movement of the first engaging member 71 into the engaging hole 721 in the second engaging member 72, thereby resulting in the engagement between the first and second engaging members 71, 72. In this embodiment, the second side surface 533 of the stop section 53 of the terminal seat 5 is substantially flush with the end surface 724 of the second engaging member 72 when the first engaging member 71 is retained in the engaging hole 721. Afterward, the bendable members 62 of the housing 6 are bent to abut respectively against the end portions 531 of the stop section 53 of the terminal seat 5 to complete the process of assembling the micro USB receptacle 4 of the invention.

Compared to the prior art, the inclined guide surface 711 of the first engaging member 71 of the engaging unit 7 reduces the resistance between the first and second engaging members 71, 72 when the terminal seat 5 is extended into the housing 6, thereby facilitating assembling the micro USB receptacle 4 of the invention. Besides, when the terminal seat 5 is extended into the housing 6, the inclined guide surface 711 also prevents the first engaging member 71 from being scraped by the second engaging member 72, which would reduce the height (H) of the stop surface 712 of the first engaging member 71. Moreover, since the stop surface 712 confronts the inner surrounding surface 722 when the first engaging member 71 engages the second engaging member 72, in the event that a force is applied to the housing 6 in the same direction as that in which the terminal seat 5 is extended into the housing 6, the stop surface 712 will abut completely against the inner surrounding surface 722 to effectively arrest separation of the terminal seat 5 from the housing 6. The disposition of the bendable members 62 of the housing 6 further secures the terminal seat 5 to the housing 6. Furthermore, compared to each of the resilient plates 32 of the prior art, the second engaging member 72 has no minimum length limitation to preserve the resiliency thereof, such that the housing 6 can be further miniaturized in the present invention.

It should be noted that, the inclined surface 521 and the second connecting surface 713 may be omitted in other embodiments of this invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A micro universal serial bus ("USB") receptacle comprising:

a housing surrounding an axis;

a terminal seat extending into the housing along the axis; and an engaging unit having a first engaging member that is provided on the terminal seat, and a resilient second engaging member that is provided on the housing having an engaging hole with an inner surrounding surface defining the engaging hole, the second engaging member being resiliently deformable so as to allow insertion of the first engaging member into the engaging hole via a movement of the terminal seat into the housing, wherein the first engaging member is formed with a stop surface for abutting against the inner surrounding surface of the second engaging member to arrest separation of the terminal seat from the housing.

2. The micro USB receptacle as claimed in claim 1, wherein the first engaging member of the engaging unit is further formed with an inclined guide surface that is inclined relative to the axis, and that abuts against the second engaging member of the engaging unit to cause resilient deformation of the second engaging member to enable the movement of the first engaging member into the engaging hole in the second engaging member when the terminal seat is extended into the housing.

3. The micro USB receptacle as claimed in claim 2, wherein the housing has a surrounding wall surrounding the axis and defining a receiving space that receives the terminal seat therein, and a pair of slits formed in the surrounding wall, flanking the second engaging member of the engaging unit, and extending parallel to the axis.

4. The micro USB receptacle as claimed in claim 3, wherein the second engaging member of the engaging unit has a guide corner that slides on the inclined guide surface when the terminal seat is extended into the housing.

5. The micro USB receptacle as claimed in claim 3, wherein the receiving space defined by the surrounding wall of the housing has opposite first and second openings, the terminal seat being extended into the housing via the first opening.

6. The micro USB receptacle as claimed in claim 5, wherein the terminal seat has:

a connecting section disposed in the receiving space defined by the surrounding wall of the housing and formed with the first engaging member of the engaging unit;

an extending section extending from the connecting section toward the second opening of the receiving space along the axis; and a stop section formed at one end of the connecting section opposite to the extending section, extending outwardly of the surrounding wall along the axis, and having a pair of end portions that are formed at opposite sides of the axis and that abut against the surrounding wall.

7. The micro USB receptacle as claimed in claim 6, wherein the connecting section of the terminal seat has a first side surface from which the extending section extends, the distance between the first side surface and each of the end portions of the stop section of the terminal seat being 0.6 millimeters.

8. The micro USB receptacle as claimed in claim 7, wherein the second engaging member of the engaging unit has a guide corner that slides on the inclined guide surface when the terminal seat is extended into the housing.

9. The micro USB receptacle as claimed in claim 8, wherein:

the second engaging member of the engaging unit further has an end surface spaced apart from the inner surrounding surface thereof and connected to the guide corner thereof; and the stop section of the terminal seat has a recess portion formed between the end portions thereof and having a second side surface that is substantially flush with the end surface of the second engaging member when the first engaging member is retained in the engaging hole.

10. The micro USB receptacle as claimed in claim 9, wherein the housing further has a pair of bendable members flanking the second engaging member of the engaging unit, extending parallel to the axis, and being bent to abut respectively against the end portions of the stop section of the terminal seat.

11. The micro USB receptacle as claimed in claim 6, wherein the second engaging member of the engaging unit has a guide corner that slides on the inclined guide surface when the terminal seat is extended into the housing.

12. The micro USB receptacle as claimed in claim 11, wherein:

the second engaging member of the engaging unit further has an end surface spaced apart from the inner surrounding surface thereof and connected to the guide corner thereof; and the stop section of the terminal seat has a recess portion formed between the end portions thereof and having a side surface that is substantially flush with the end surface of the second engaging member when the first engaging member is retained in the engaging hole.

13. The micro USB receptacle as claimed in claim 12, wherein the housing further has a pair of bendable members flanking the second engaging member of the engaging unit, extending parallel to the axis, and being bent to abut respectively against the end portions of the stop section of the terminal seat.

* * * * *